United States Patent [19]

Sanders

[11] 4,342,579

[45] Aug. 3, 1982

[54] METHOD AND APPARATUS FOR COLLECTING STRAND

[75] Inventor: James E. Sanders, Newark, Ohio

[73] Assignee: Owens-Corning Fiberglas Corporation, Toledo, Ohio

[21] Appl. No.: 229,682

[22] Filed: Jan. 29, 1981

[51] Int. Cl.[3] ..... C03B 37/025

[52] U.S. Cl. ..... 65/2; 65/10.1; 65/29; 65/158; 242/18 G; 242/36

[58] Field of Search ..... 65/2, 10.1, 29, 158; 242/18, 36

[56] References Cited

U.S. PATENT DOCUMENTS

| | | | |
|---|---|---|---|
| 3,471,278 | 10/1969 | Lonberger . | |
| 3,652,243 | 3/1972 | Jensen et al. | 65/2 |
| 3,844,497 | 10/1974 | Harrill et al. | 242/36 |
| 4,130,406 | 12/1978 | Wakasa et al. | 65/2 |
| 4,146,376 | 3/1979 | Beckman et al. . | |
| 4,147,526 | 4/1979 | Griem . | |

FOREIGN PATENT DOCUMENTS

| | | | |
|---|---|---|---|
| 461068 | 4/1975 | U.S.S.R. | 65/10.1 |

*Primary Examiner*—Robert L. Lindsay, Jr.

*Attorney, Agent, or Firm*—Ronald C. Hudgens; Philip R. Cloutier; Greg Dziegielewski

[57] ABSTRACT

A method and apparatus for collecting strand are provided comprising: supplying a first strand segment; rotating a member to collect the first strand on the member; varying the speed of the rotatable member according to a predetermined pattern; sensing the absence of the first strand being wound around the member to identify a reference point in the pattern at the incidence of sensing the absence of the first strand; supplying a second strand segment to the member; initiating collection of the second strand upon the member having the first strand segment thereon substantially at a speed substantially corresponding to the reference point in the pattern; and continuing to rotate the member according to the pattern subsequent to the reference point to wind the second strand segment therearound.

20 Claims, 2 Drawing Figures

METHOD AND APPARATUS FOR COLLECTING STRAND

TECHNICAL FIELD

The invention disclosed herein relates to method and apparatus for providing substantially full packages of glass fiber strand having a generally uniform diameter along the length of the strand in spite of process interruptions during the package build cycle.

BACKGROUND ART

One method for manufacturing textiles from glass involves attenuating a plurality of streams of molten glass into fibers, collecting the fibers into a strand and winding the strand into a package for subsequent use in manufacturing various products. The molten glass initially flows at a controlled rate from a furnace forehearth into a feeder or bushing which has a plurality of orifices formed in its bottom. As the molten glass flows from the orifices, streams of molten glass are pulled downwardly at a high rate of speed for attenuation into fibers. The plurality of attenuated fibers are then gathered together into a strand, coated with a sizing, and the strand is wound onto a package on a winder collet. The speed of the winder is controlled in an attempt to maintain a uniform attenuation speed which, in turn, produces a uniform diameter in the attenuated fibers if other conditions such as the temperature of the molten glass remain constant. Since the strand is helically wound in layers to form a package, the diameter of the package will gradually increase. As the diameter increases, the rotational speed of the collet must be proportionally decreased to maintain a constant attenuation rate.

Various controls have been known in the prior art for controlling a winder collet speed at a substantially uniform attenuation rate as the size of a package on which glass fibers are wound changes. In a typical prior art system, a digital computer or other process controller stores data corresponding to a desired winder collet speed at different predetermined points of time after the start of winding a package. At each of these points of time, the winder collet speed is sampled and compared with the desired speed for generating an error signal. The error signal is used to modify the winder collet speed in order to reduce the deviation between the desired speed and the actual speed. In one prior art system, as illustrated in U.S. Pat. No. 3,471,278 which issued Oct. 7, 1969, the winder speed is controlled by means of a magnetic clutch connecting a constant speed motor to a generator. The output from the generator, in turn, drives the winder motor. A digital computer generates an output signal which is converted to an analog signal for driving a ramp function generator. The ramp function generator, in turn, drives the magnetic clutch to warp or ramp down the speed of the winder collet as the diameter of the package increases to maintain a constant fiber attenuation and strand collection speed. In order to change the product collected on the winder, a different analog winder speed ramp curve must be stored in the digital computer.

In other systems, the winder speed is digitally controlled to maintain a predetermined attenuation and collection rate for a strand of glass fibers. A constant speed motor is connected though an electro-magnetically actuated clutch for driving a winder collet. An integrated circuit microcomputer or microprocessor which receives feedback data on the actual winder collet speed, generates a digital output which is used for phase firing two SCRs. This, in turn, controls power to the magnetic clutch for controlling coupling between the constant speed motor and the winder collet.

The winder collet speed is controlled in accordance with a third order polynomial which provides a predetermined speed curve. The actual curve for each product is determined by the constants in the polynomial. The polynomial is programmed into a microcomputer or other digital controller for the winder. Preferably, the constants for the polynomial are stored in a separate memory which stores the constants for defining the speed curve for a number of different products. Merely by telling the microcomputer which product is to be manufactured, the appropriate constants will be read from the memory and used in solving the polynomial for any point in the speed curve from an initial starting time. In all cases, however, the speed is controlled as a function of time.

Breakouts or process interruptions in the formation of continuous glass filaments are common. Heretofore, the winders have continued to progress through a normal operating cycle in spite of the fact that the filaments may have "broken out". As such, only a partially complete package would have been generated. In some instances, such packages have been recapped. That is, additional layers of glass strand have been wound upon the initial layers subsequent to the breakout. This could provide a full package, but such packages generally do not have a strand of filaments having a generally uniform diameter along the length thereof, since the time sequence is not adjusted to compensate for the difference in breakout and restart times of the timed winding cycles.

For example, a winder may continue to run for five or ten minutes subsequent to the breakout of the filaments prior to being resupplied with strand to recap the partial package. Or, when the breakout occurs very early into the package build procedure, the winder is reset to time zero and processed from that point. As such, packages having strands of glass fibers having non-uniform diameters as well as out of desired weight or yardage tolerances can be generated since the rotational speed of the winder does not have the proper package diameter associated therewith.

DISCLOSURE OF THE INVENTION

This invention pertains to method and apparatus for collecting strand as the filaments of the strand are being formed wherein the strand is comprised of filaments having generally uniform diameters along the length thereof in spite of the fact that the strand may be applied in a plurality of segments as opposed to a single continuous strand as a result of unscheduled process interruptions.

BEST MODE OF CARRYING OUT THE INVENTION

Figure 1:
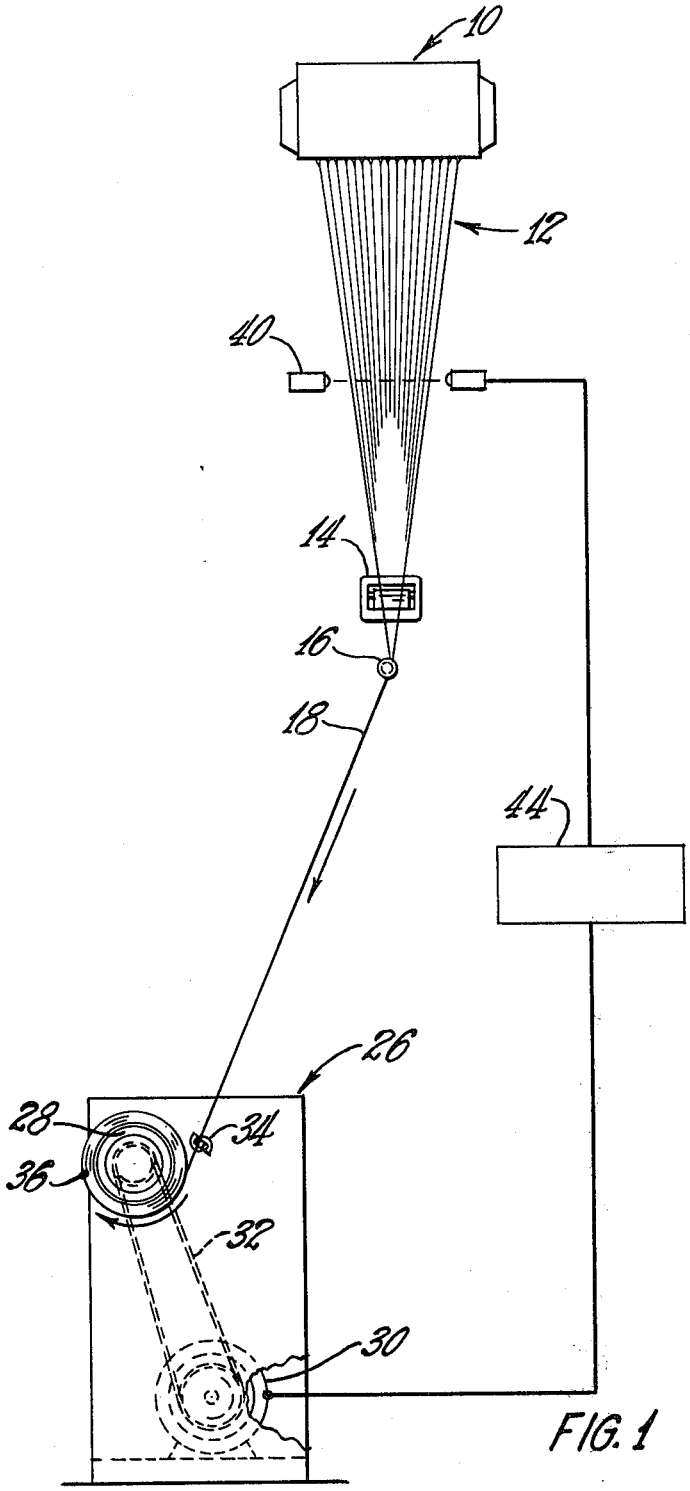
FIG. 1 is a semi-schematic elevational view of textile fiber forming operation according to the principles of this invention.

As shown in FIG. 1, feeder means 10 is adapted to supply a plurality of streams of molten material, such as glass, to be attenuated into filaments 12 through the action of winder 26. A size applicator system 14 can be provided to supply a suitable coating to protect the filaments 12 prior to the passage of the filaments 12 through gathering means 16 to gather filaments 12 into strand 18.

At winder 26, rotatable member or collet 28 which can be connected to motive means 30 by means of belt 32 to be rotatably driven thereby. As is known in the art, strand 18 in wound on member 28 in helically oriented layers by means of traversing means or spiral wire 34. As such, a helically wound package of glass fiber strand is generated.

In many instances, process interruptions or breakouts do occur in the production of packages of glass fiber strands. Although a package consisting of a single continuous segment of strand is generally preferred, in many instances a package comprised of a plurality of such segments wound into a helical package essentially as if a single segment were employed can be acceptable. For example, in roving operations wherein a plurality of strands are combined into a larger strand, such recapped packages can be acceptable, especially wherein a roving process and apparatus according to the principles set forth in U.S. Pat. No. 4,143,506 issued to Pierce et al. is employed.

It is to be understood that the present invention can be employed with winders having control systems comprised of timers, contacts, relays, and the like and/or can be employed with winders incorporating microcomputer or microprocessor technology and the like.

Microcomputer controlled winders and/or textile fiber forming systems can be employed similar to those set forth in U.S. Pat. No. 3,471,278 issued to P. D. Griem, Jr.; U.S. Pat. No. 4,146,376 issued to Beckman et al.; and U.S. Pat. No. 4,147,526 issued to Lonberger.

In the present invention, control means 44, which can be of the previously mentioned contact and relay type circuitry and/or microcomputer circuitry, cooperates with signal means or sensor 40 and motive means 30 to control the speed of collet 28.

As shown in FIG. 1, sensor 40 is an electro-optical device scanning the filaments 12, intermediate feeder 10 and size applicator means 14. However, it is to be understood that sensor 40 can be of any suitable type, whether it be electrical, mechanical, optical, or the like. Further, the sensor need not be associated with the fan of filaments, but can be placed at any point to sense the presence or absence of strand 18 being supplied to winder 26. In essence, the sensing of elements 12 is, in effect, the sensing of strand 18 with regard to the aspect of being supplied to winder 26 for the principles of this invention.

During operation, if a process interruption or filament breakout occurs, sensor 40 senses the absence of the filaments or strand being supplied to member 28. In response to the said sensing, a first signal is supplied to control means 44 by means of conventional electrical leads. At that point, control means 44 is adapted to identify the reference point or time and then hold or store the time of the breakout as occurring in the time sequence from time start to time out in the predetermined pattern or cycle.

As is known in the art, during collection of the strand into a wound package, a gradual build up of the package radius occurs in the packaging cycle. During a packaging cycle, the linear speed of attentuation of the fiber or filament from the feeder is determined both by the rotational speed of the package and by the circumference of the package which is based upon a relatively small radius. As build up of the package occurs, the speed of attenuation is dependent upon the increasing circumference of the package. If the speed of attenuation is allowed to increase, the diameter of the attenuated fiber will decrease, provided the temperature of the molten glass and other factors remain constant. This is due to the fact that the flow rate of the molten glass through the orifices in the feeder is determined, in part, by the viscosity of the glass which, in turn, is temperature dependent. Therefore, it is desirable to decrease the speed of the winder collet 28 as the package builds up to maintain a constant linear speed for attenuating the filaments 12 to produce glass filaments having a generally uniform diameter along the length of the filaments.

In addition, the packaging cycle is generally determined as a function of time. That is, among other things, for a given package, a preselected length of time of package build is identified and the winder speed is determined as a function of time. That is, the rotational speed of member 28 is controlled or varied as a function of time according to a predetermined pattern or cycle.

There are a number of ways to control the rotational speed of member 28. For example, motive means 30 can be comprised of a variable speed motor which is attached to belt 32, or motive means 30 can be comprised of a constant speed motor having a speed compensation device, such as an electrical clutch or the like, intermediate belt input 32 and the motor, as is set forth in the aforementioned patents.

Preferably, a microprocessor or microcomputer controlled winding system is employed.

Assuming that a breakout occurs during the packaging cycle, sensor 40 senses the absence of the filaments 12 comprising the strand 18 and generates a first event signal which is supplied to control means 44. In response to such a first event signal, a reference point is identified in the time sequence of the packaging cycle. The reference point can be stored in the control means to permit the operator to resupply the streams of molten glass, generally as primary or crudely attenuated fibers to collet 28.

As is known in the art, collet 28 can have a temporary collection region thereon to permit the strand 18 to be collected at that region for a predetermined time, whereupon the strand will be transferred to the primary collection zone on collet 28 to collect strand 18 as package 36 in a plurality of layers.

When the operator determines that the winding system is in proper order for restart, the operator can activate a switch (not shown) which provides a second event signal to control means 44 which adjusts or controls the speed of member 28 to the speed of the collet or member 28 at the time of breakout. Simply stated, control means 44 is preprogrammed upon the reception of the second event signal to recall the reference point of time ($t_b$) in the packaging cycle, adjust the speed of the collet 28 as a function thereof to achieve the rotational speed corresponding to time $t_b$ according to the predetermined equation or pattern, and continue with the packaging cycle according to that predetermined pattern or program from the reference point.

Figure 2:
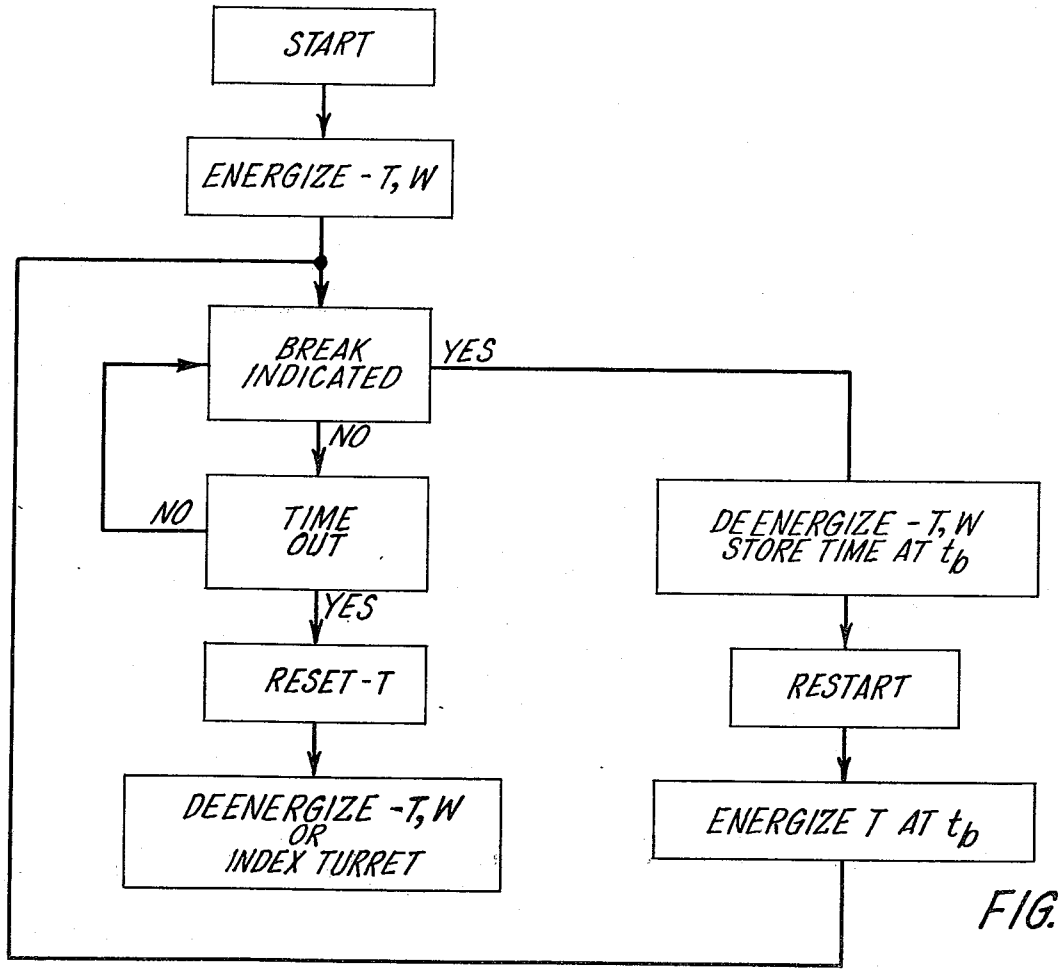
FIG. 2 is a flow chart of the logic involved in implementing the present invention.

In operation, the motive means 30 and/or collet 28, which are identified as W in FIG. 2, can be de-energized at the time of breakout. Also, timer T is de-energized at the time of breakout, $t_b$. However, it is to be understood that member 28 and/or motive means 30 need not be de-energized or stopped during breakout, but such is preferred for safety reasons.

It is also to be understood that control means 44 can be preprogrammed or configured to automatically restart after a preselected period of time. The period of time should be sufficient to enable the operator to resupply the temporary collection region or collet 28 with a strand of primary filaments. However, a simple restart switch readily accessible to the operator is preferred.

At restart, the strand 18 may be manually held at the temporary collection region of collet 28 for a period of time sufficient to permit the collet to achieve the desired speed, or control means 44 may be integrated with a hold-off arm or the like associated with winder 26 to mechanically align strand 18 with the temporary collection region on collet 28. As such, control means 44 can be associated with a tachometer means adapted to sense the rotational speed of motive means 30 and/or collet 28 which can be adapted to provide a signal to control means 44 to activate the hold-off mechanism to return the strand to the primary package build position on collet 28.

From FIG. 2 it can be seen that the present invention is capable of providing a full package of strand, that is, a package of sufficient diametral size having filaments of a generally uniform diameter along the length thereof, in spite of the fact that the process may have been interrupted at least once. Theoretically, a full package may be achieved in spite of numerous breakouts during the packaging cycle. However, it may be desirable to limit the number of permissible strand breaks to a predetermined number. As such, control means can be adapted to count the number of breakout or process interruption events requiring the capping of an inner layer of the package with another layer of strand. An alarm may be activated and/or the package may be rejected at that point.

The microcomputer or microprocessor 44 can be a commercially available unit and generally comprises an integrated circuit central processing unit, a plurality of integrated circuit read only memories (ROM) which store a fixed program and fixed data and one or more integrated circuit random access memories (RAM) which temporarily store input and output data, as well as data being operated on by the central processing unit. The microcomputer controller 44 can be provided with various inputs, such as timer inputs, a feedback speed input from the winder collet and the like. For example, see aforementioned U.S. Pat. No. 4,147,526, which is hereby incorporated by reference.

It is to be understood that it is within the perview of this invention that the collet speed may be slightly modified according to the system set forth in aforementioned U.S. Pat. No. 4,146,376 to compensate for bushing temperature fluctuations and the like in response to breakouts. That is, it is to be understood that returning the collet to the speed at which it was rotating prior to the time of breakout may be adjusted for bushing operation parameter discrepancies and the like for a period of time and still be within the essence of the present invention.

It is also to be understood that signal means 40 may be a switch capable of being manually activated by an operator who perceives that a breakout or a process interruption has occurred. That is, signal means 40 may be a manually operable switch to be activated by the operator.

The present invention is also capable of being employed on winders having a plurality of collets mounted on a rotatable or indexable head or turret.

It is apparent that within the scope of the present invention, modifications and different arrangements can be made other than as herein disclosed. The present disclosure is merely illustrative with the invention comprehending all variations thereof.

INDUSTRIAL APPLICABILITY

The invention described herein is readily applicable to the formation of continuous inorganic filaments and/or strands and the collection thereof.

I claim:

1. A method of collecting glass filaments comprising:
- supplying a plurality of streams of molten glass;
- rotating a member to attenuate said streams into filaments and to collect said filaments as a first strand of glass filaments on said member in layers;
- varying the speed of said rotatable member according to a predetermined pattern;
- sensing the absence of said first strand being wound around said member to identify a reference point in said pattern;
- supplying a second strand of glass filaments to said member from said streams;
- initiating collection of said second strand upon said member over said first strand thereon at a speed substantially corresponding to said reference point in said pattern; and
- continuing to rotate said member according to said pattern subsequent to said reference point to attenuate said streams into filaments and to collect such filaments as said second strand of glass filaments thereon.

2. The method of claim 1 wherein said speed is controlled as a function of time.

3. The method of claim 1 wherein said reference point is established by means of a timer.

4. The method of claim 1 wherein said reference point is established according to the speed of said member.

5. The method of claims 4 or 5 further comprising deactivating said rotatable member in response to said sensing.

6. Apparatus for collecting glass filaments comprising:
- means for supplying a plurality of streams of molten glass;
- a rotatable member adapted to attenuate said streams into said filaments and to collect said filaments thereon;
- motive means adapted to rotate said member;
- signal means adapted to supply a first signal to an after defined control means in response to an absence of a first strand of said filaments being wound upon said member; and
- control means adapted to control the speed of rotation of said motive means according to a predetermined pattern; said control means being responsive to said first signal to identify a reference point in said pattern at which said first signal was received and store said point, said control means being responsive to a second signal to effect the collection of a second strand of said filaments upon said member over said first strand at the speed of rotation of said motive means at said reference point in said pattern.

7. The apparatus of claim 6 wherein said signal means is a sensor adapted to sense the presence of at least a portion of said first strand.

8. The apparatus of claim 7 wherein said sensor is an electro-optical device.

9. The apparatus of claim 6 wherein said control means comprises a microprocessor.

10. The apparatus of claim 6 wherein said signal means is a manually operable switch.

11. A method of collecting glass filaments comprising:

supplying a plurality of streams of molten glass;

rotating a member adapted to attenuate said streams into said filaments and collect said filaments around said member in layers;

controlling the speed of rotation of said member as a function of time according to a predetermined cycle;

sensing the absence of said filaments being wound around said member;

providing a signal to a control means to identify a reference point in said cycle substantially corresponding to the point of sensing;

storing said reference point;

rotating said member at the speed corresponding to the speed of said member according to said reference point; and initiating collection of said filaments upon said member over said layers to collect said filaments as a package when the speed of said member is substantially equal to the speed of the member according to said reference point, the speed of said member substantially following said cycle from said reference point.

12. A method of collecting glass filaments comprising:

supplying a plurality of heat softened glass streams;

rotating a member adapted to attenuate said streams into filaments and collect a first group of said filaments around said member in layers at a package formation region on said member;

controlling the speed of rotation of said member according to a predetermined equation, the speed of the member being a function of time;

sensing the absence of said first group of filaments;

generating a first signal in response to said sensing;

storing a reference point in time corresponding to said sensing in response to said first signal;

supplying a second group of said filaments to a temporary collection region on said member;

generating a second signal;

recalling said reference point in response to said second signal;

rotating the member at the speed corresponding to said reference point;

initiating collection of said second group of filaments at the package formation region of said member when said member is rotating substantially at the speed corresponding to said reference point; and winding said second group of filaments over said layers according to the remainder of said cycle from said reference point.

13. The method of claims 11 or 12 further comprising gathering said filaments into a strand prior to winding said filaments on said member.

14. The method of claim 13 wherein filaments are sensed prior to gathering said filaments into said strand.

15. The method of claim 11 wherein said first signal is provided by manually activating a switch.

16. The method of claim 12 wherein the speed of said member is controlled to attenuate said streams into filaments having a substantially uniform diameter along their lengths throughout the package.

17. The method of claim 12 further comprising counting the number of said sensings and rejecting the package if said number exceeds a predetermined value.

18. The method of claims 11 or 12 wherein the speed of said member is controlled by adjusting the speed of a variable speed motor.

19. The method of claims 11 or 12 wherein the speed of said member is controlled by controlling a device attached to a constant speed motor.

20. Apparatus for collecting glass filaments comprising:

means for supplying a plurality of streams of molten glass;

a rotatable member adapted to attenuate said streams into said filaments and to collect said filaments thereon;

motive means adapted to rotate said member;

signal means adapted to supply a first event signal to an after defined control means in response to an absence of a first group of said filaments being collected upon said member; and control means adapted to control the speed of rotation of said motive means according to a predetermined pattern; said control means being responsive to said first signal to identify a reference point in said pattern at which said first signal was received and store said point, said control means being responsive to a second signal to effect the collection of a second group of said filaments upon said member over said first group of filaments at the speed of rotation of said motive means at said reference point in said pattern.

* * * * *